US008527127B2

(12) United States Patent
Jacques et al.

(10) Patent No.: US 8,527,127 B2
(45) Date of Patent: Sep. 3, 2013

(54) METHOD AND SYSTEM FOR OIL LIFE MONITORING

(75) Inventors: Robert Lionel Jacques, Troy, MI (US); Matthew J. Snider, Howell, MI (US); Andrew E. Buczynsky, Brownstown, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 299 days.

(21) Appl. No.: 13/024,437

(22) Filed: Feb. 10, 2011

(65) Prior Publication Data

US 2012/0209460 A1 Aug. 16, 2012

(51) Int. Cl.
*F01M 11/10* (2006.01)

(52) U.S. Cl.
USPC ..... 701/22; 180/65.21

(58) Field of Classification Search
USPC ..... 701/22, 104, 29.4, 29.5, 102; 180/65.21; 903/902; 324/698; 340/457.4; 702/55; 70/114.55, 290 R; 123/196 R
See application file for complete search history.

(56) References Cited

U.S. PATENT DOCUMENTS 4,796,204 A * 1/1989 Inoue ..... 123/196 S
6,327,900 B1 * 12/2001 Mc Donald et al. ..... 73/114.55

* cited by examiner

*Primary Examiner* — Marthe Marc-Coleman
(74) *Attorney, Agent, or Firm* — Quinn Law Group, PLLC

(57) ABSTRACT

A method and system of determining a maximum oil change limit for an engine considering the engine operating environment and location is provided. An engine location indicator is generated in response to a trigger, using a locating device in communication with a controller. The locating device may include a global positioning system (GPS) receiver. The engine may be an internal combustion engine on a vehicle configured as one of a hybrid vehicle and an extended range electric vehicle. The trigger may be one of a calendar time, a key-on event, an oil change event, and a signal provided by the controller. The controller may generate the maximum oil change limit of the engine using one or more oil change indices, each defined by the engine location and/or time in location. The maximum oil change limit and/or an oil change limit alert may be provided as an output of the controller.

20 Claims, 2 Drawing Sheets

METHOD AND SYSTEM FOR OIL LIFE MONITORING

TECHNICAL FIELD

The present invention relates to a method and system for determining the oil change limit of an engine.

BACKGROUND

The oil filter assembly and oil used for lubrication of an internal combustion engine (ICE) of a vehicle are consumables having a finite useful life and therefore require periodic replacement through the life of the engine to avoid damage to the engine and/or related engine components. At the end of its useful life, the oil may lose its ability to sufficiently lubricate the engine, such that engine components may wear or seize. The oil filter assembly, also commonly referred to as the oil filter, or the filter, at the end of its useful life, may lose its ability to filter contaminants from the oil, water degradation of the filter media may occur, the filter may become blocked such that oil flow through the engine is decreased or stopped, or the filter may otherwise deteriorate such that oil is leaked from the engine through the canister, attachment portion, and/or gasket of the oil filter assembly.

Replacement of the oil filter assembly and the engine oil, where the replacement of both the filter and the oil is commonly referred to as an "oil change," represents an engine operating expense. To minimize this engine operating expense, it is advantageous to maximize the time between oil changes, e.g., it is advantageous to maximize the oil change limit.

Currently, vehicle manufacturers provide a recommended engine oil change limit, which may be alternately expressed in terms of time in service and miles in service, such that when the first occurring one of these limits is met, an oil change is recommended. Because significant damage to the combustion engine and/or vehicle may occur if the oil and/or oil filter is not changed prior to the end of the useful life of the oil and/or oil filter, and because the useful life of the oil filter and the oil vary with the customer driving profile and vehicle geographic location, the vehicle manufacturer's recommended engine oil change limits are typically set based on, for example, near worst case conditions, to minimize the risk of engine damage due to degradation of the oil or the oil filter.

Oil change limits have historically been developed and validated using data obtained from combustion engines in non-hybrid powertrains. Oil change limits correlating to vehicle miles in service, for example, may be based on monitoring engine revolutions of the ICE in the vehicle. In a hybrid powertrain where, for example, the vehicle is operated for a significant portion of time for significant distances using an electric motor or other non-ICE power source, engine operating revolutions (cycles) in service are significantly reduced and no longer correlate to total vehicle miles.

SUMMARY

In some circumstance, for example, in the case of a hybrid powertrain where engine operating revolutions (cycles) in service are significantly reduced and no longer correlate to total vehicle miles, time in service, that is, time spent in the operating environment, may become the controlling factor for oil change frequency on the ICE. Corrosion-related degradation or time-based deterioration of the engine oil filter and/or engine lubricant, which may be influenced by the vehicle operating environment, may become a more predominant consideration in determining a recommended oil change limit.

By incorporating an indicator of the operating environment in determination of the oil change limit of an engine, the oil change limit may be adjusted in anticipation of corrosive factors influenced by the engine operating environment, including, for example, temperature and humidity, and time in service in a particular operating environment. The operating environment indicator may be, for example, a geographic indicator, such as a location indicator. In a hybrid vehicle such as an extended range electric vehicle (EREV), e.g., the hybrid vehicle may be operated for a significant distance or length of time without operating (revolving or cycling) the internal combustion engine (ICE). In this instance, time-dependent, and/or corrosion-related failure modes, such as rusting of the oil filter can, gasket creep of the oil filter seal, or water degradation of the oil filter media, may be the controlling factors influencing oil and oil filter life of the engine, and therefore, maximum oil change limits for the engine. These failure modes may be further exacerbated by extreme temperature conditions. Accordingly, it is advantageous to adjust the oil change limits for an EREV vehicle operating in a highly corrosive environment, to minimize the risk of damage to the ICE due to oil or oil filter degradation which may be accelerated by the corrosive environment. It is also advantageous to provide a method and system to maximize oil change limits while considering the vehicle operating environment, to minimize the owner's maintenance expense associated with oil changes.

A method and system of maximizing an oil change limit for an engine is provided, wherein the oil change limit is determined considering the engine operating environment. The method includes providing a current location indicator of an engine to a controller in response to a current trigger. The location indicator of the engine may be provided using a locating device in communication with the controller, wherein the locating device may be configured to include a global positioning system (GPS) receiver. The engine may be an internal combustion engine on a vehicle, and the vehicle may be configured as one of a hybrid vehicle and an extended range electric vehicle. The trigger may be one of a calendar time, a key-on event, an oil change event, a signal provided by an engine control system, a signal provided by an oil life monitor, and a signal provided by the controller.

The controller may include one or more of an oil life monitor and an engine control unit. The controller may be configured to generate and store an oil change index and a maximum oil change limit. The controller may be configured with one or more algorithms to generate the oil change index and the maximum oil change limit. The controller may generate a current oil change index using the current location indicator and a current location rating. The controller may be configured to generate the maximum oil change limit of the engine using the current oil change index, or using the current oil change index and at least one prior oil change index. The current oil change index, one or more prior oil change indices, and the maximum oil change limit may be stored in a database using the controller, and/or accessible by the controller. The maximum oil change limit may be provided as an output of the controller.

The method may further include inputting a last oil change event into the controller, comparing the maximum oil change limit to the last oil change event, and outputting an oil change limit alert when the maximum oil change limit has been met or exceeded, using the controller and/or an output device.

The at least one prior oil change index may include at least one of an oil change index provided to the oil change monitor as an initial oil change index, and an oil change index generated after a last oil change event in response to a prior trigger. Generating a current oil change index may include measuring the elapsed time between the current trigger and a last trigger, time-weighting the current location rating using the elapsed time, and generating the current oil change index using the time-weighted current location rating. The maximum oil change limit generated using the time-weighted current oil change index may be provided as a time-weighted maximum oil change limit.

A system for determining a maximum oil change limit of an engine is provided. The system may include an engine, a locating device configured to provide a current location indicator of the engine in response to a current trigger, and a controller in communication with the locating device. The locating device may include a global positioning system (GPS) receiver. The trigger may be defined by one of a calendar time, an engine-on event, a key-on event, an oil change event, a signal provided by an engine control unit, and a signal provided by the controller.

The controller may be configured to generate a current oil change index using the current location indicator, store at least one prior oil change index, generate a maximum oil change limit for the engine using at least one of the current oil change index and at least one prior oil change index, and store the maximum oil change limit. The controller may be configured to measure the elapsed time between the current trigger and a last trigger, time-weight the current location rating using the elapsed time, to generate the current oil change index using the time-weighted current location rating, and to generate the maximum oil change limit as a time-weighted maximum oil change limit.

The controller may be further configured to receive a last oil change event as an input, to compare the maximum oil change limit and the last oil change event, and to output an oil change limit alert when the maximum oil change limit is met or exceeded. The system may further include an output device configured to communicate at least one of the maximum oil change limit and an oil change limit alert.

The engine may be configured as an internal combustion engine in a vehicle, and the vehicle may be configured as a hybrid vehicle, as an extended range electric vehicle, or with a conventional (non-hybrid) powertrain including an internal combustion engine. The engine may be configured as an internal combustion engine in a non-vehicle application, such as in a generator or power generation system.

The above features and other features and advantages of the present invention are readily apparent from the following detailed description of the best modes for carrying out the invention when taken in connection with the accompanying drawings.

DETAILED DESCRIPTION

Figure 1:
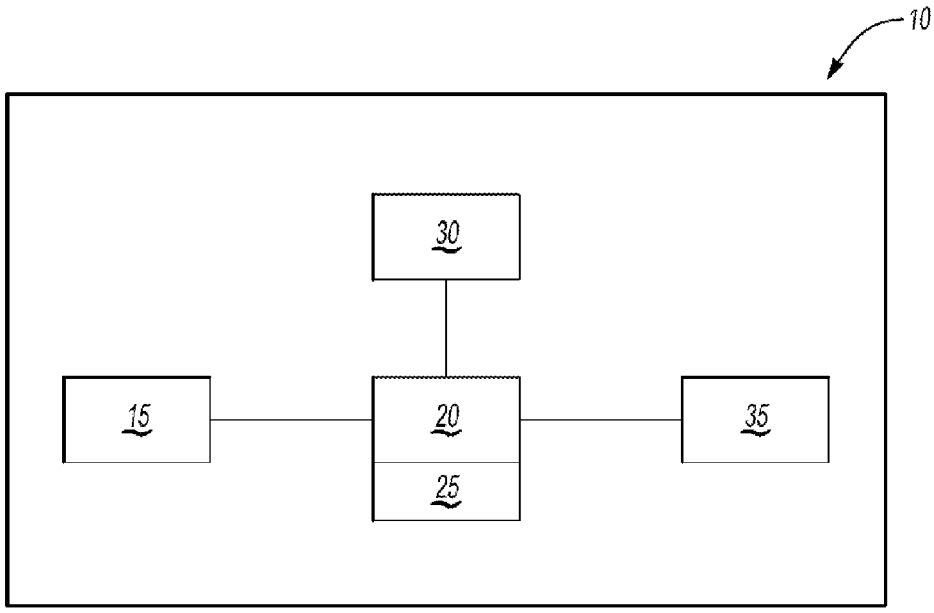
FIG. 1 is a schematic illustration of vehicle configured to include an engine and an engine oil life monitoring system.
Figure 2:
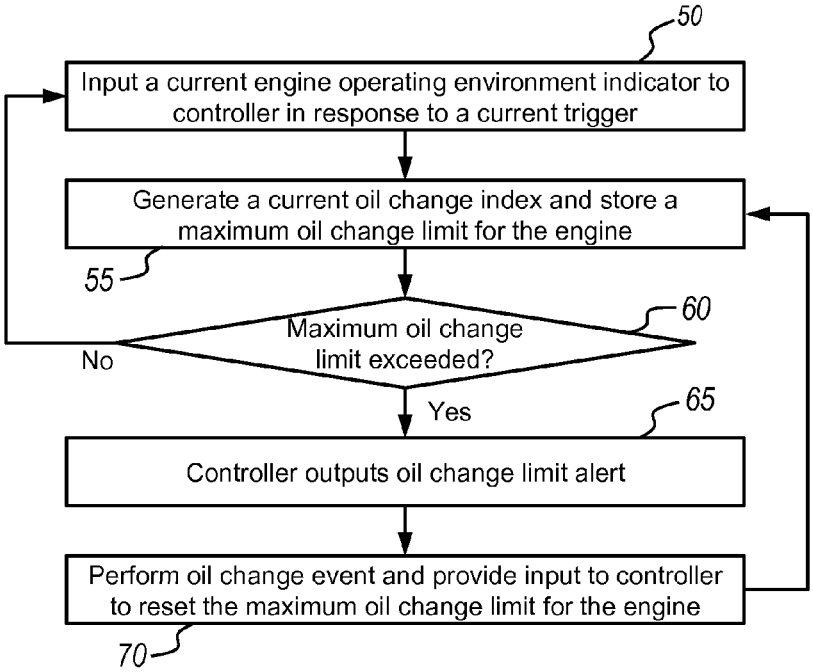
FIG. 2 is a schematic illustration of a method for generating and monitoring a maximum oil change limit on an engine.
Figure 3:
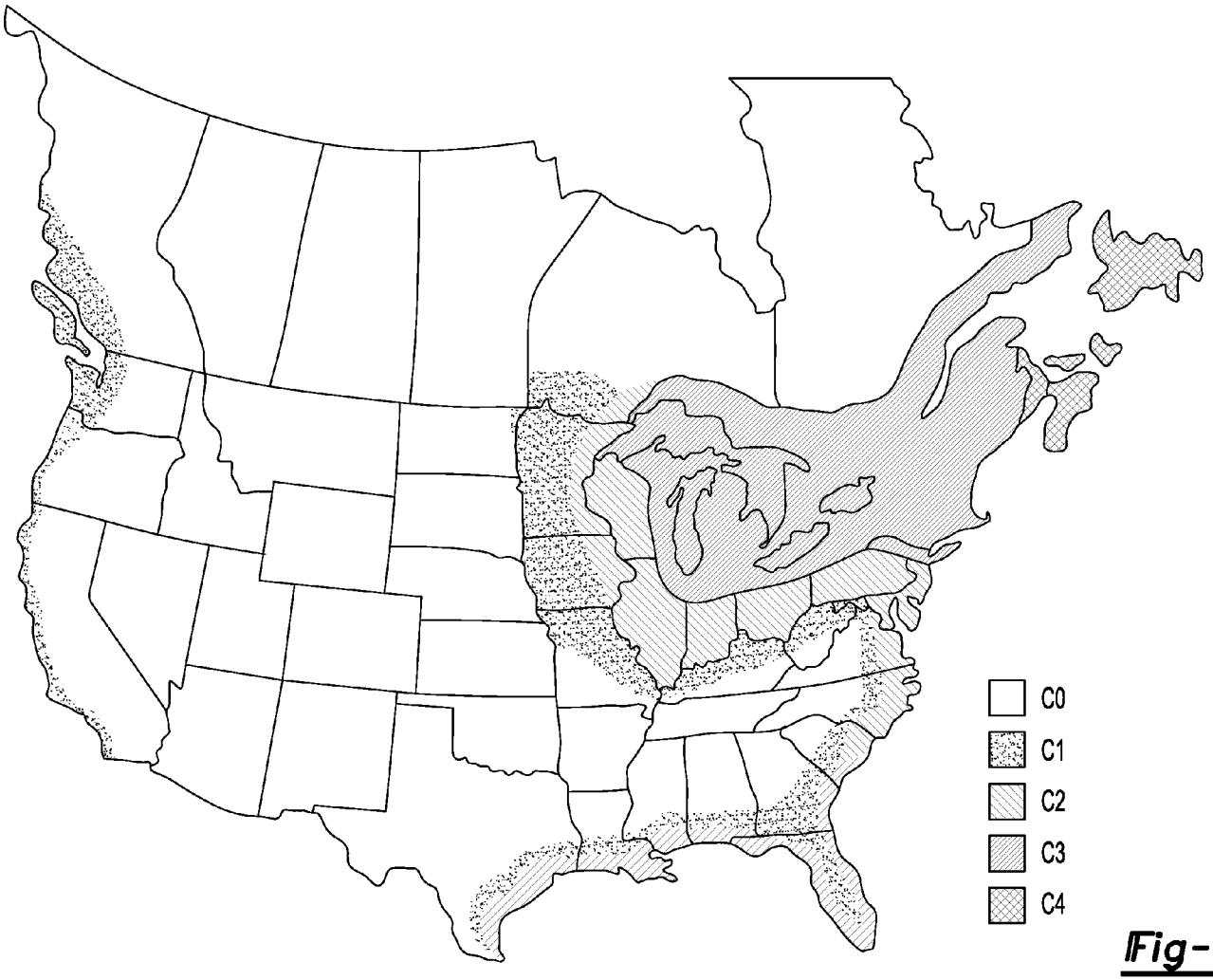
FIG. 3 is a schematic illustration of a partial map of North America defining areas of varying corrosivity.

Referring to the drawings wherein like reference numbers represent like components throughout the several figures, the elements shown in FIGS. 1-3 are not to scale or proportion. Accordingly, the particular representations, dimensions and applications provided in the drawings presented herein are not to be considered limiting.

FIG. 1 is a schematic illustration of a system generally indicated at 10. The system 10 includes a controller 20 and an engine 15. The controller 20 includes an algorithm 25, wherein the algorithm 25 may be configured to generate an oil change index and a maximum oil change limit of the engine 15. The controller 20 may be defined by one or more of an engine control module (not shown), also referred to as an engine control unit, and an oil life monitoring module (not shown), also referred to as an oil life monitor or lubrication control module.

The controller 20 may be further defined by and/or configured to be in operative communication with one or more of the engine 15, a locating device 30, and an output device 35. The locating device 30 may be configured to determine the location of the engine 15, and to provide the location as a location indicator to the controller 20. The locating device 30 may be prompted to provide the location indicator in response to a trigger. The locating device 30 may include a global positioning system (GPS) receiver, or other suitable means by which the locating device 30 can determine the current geographic position of the engine 15 in response to a trigger.

The output device 35 may be configured to communicate one or more of a maximum oil change limit, a last oil change event, and an oil change alert, by one or more of an audio or visual output. By way of non-limiting examples, the output device 35 may provide an audio output configured as an alert tone or signal, and/or as an audio message, which may be a speech message or other human hearable message format. By way of non-limiting examples, the output device 35 may provide a visual output configured as a warning light, a dash light, a message displayed by the output device as a character string, symbol, or other human readable format. The output device 35 may be included in a display module (not shown) which is configured to communicate information related to the system 10, including, for example, operating conditions such as oil life indicators, fuel level indicators, operating temperature, in-service parameters such as time in service, miles in service, operating cycles (engine revolutions) completed, etc. By way of non-limiting example, the output device 35 may be configured as a dashboard display or audio/visual driver information system in the instance where system 10 is configured as a vehicle. As another example, the output device 35 may be configured as a control panel capable of audio and/or visual output in the instance where system 10 is configured as a non-vehicle system, for example, as in a power generation installation.

In a non-limiting example, the system 10 may be a conventionally (non-hybrid) powered system, e.g., a system which is powered by the internal combustion engine 15. In another non-limiting example, the system 10 may be a hybrid system powered by the internal combustion engine 15 or powered by another non-combustion power source, for example, an electric motor which may be configured as a hybrid motor fueled by an electrical source which may be, for example, a battery, or powered by a combination of the engine 15 in the non-combustion power source.

The system 10 may be configured as a vehicle. The vehicle 10 may be configured with a conventional powertrain, e.g., with a powertrain powered by the internal combustion engine 15. In another non-limiting example, the vehicle 10 may be a hybrid vehicle, such as an extended range electric vehicle, defined by a powertrain which may be powered by an internal combustion engine 15, a hybrid power source (not shown)

such as a motor driven by an electrical source, a battery, and/or a combination of these. The vehicle 10 may be of any type vehicle which may be powered by an internal combustion engine (ICE) 15 and/or an ICE 15 in combination with a hybrid power source, which may include, by way of non-limiting example, any type of ICE powered automobile, truck, bus, recreational vehicle, commercial vehicle, off-road equipment such as farming, mining and construction equipment, boats, and any other ICE powered aircraft, watercraft or marine equipment.

In another non-limiting example, the system 10 may be a non-vehicle system configured to be powered by an ICE and/or an ICE in combination with a hybrid power source, which may include, by way of non-limiting example, any type of ICE powered generator, power generation system, or ICE powered industrial system, and including stationary or semi-stationary installations of ICE powered systems, including portable and/or trailerable ICE powered or ICE-based power generation systems.

The engine 15 may be configured an internal combustion engine (ICE). The internal combustion engine 15 may be, by way of non-limiting example, configured to be fueled by petroleum based fuels including gasoline and petrodiesel, methanol, ethanol, biofuels including vegetable oil based fuels, biobutanol, biomethanol, bioethanol, hydrogen, compressed natural gas, or as a flex-fuel engine which may be fueled by a combination of these.

The engine 15 may include an engine lubrication system (not shown) which is monitored by the controller 20. The engine lubrication system may be configured as an oil lubrication system of the type typically used to lubricate adjacent moving components of an internal combustion engine, to decrease heat caused by friction and reduce component wear in the engine. The controller 20 may be configured in communication with the engine 15, including the engine lubrication system of the engine 15, and may be configured to monitor various characteristics of the engine 15 including the engine lubrication system. The characteristics monitored by the controller 20 may include, for example, one or more engine in-service parameters such as time in service, miles in service, and engine operating cycles (engine revolutions) completed, and/or one or more of the pressure, temperature, viscosity, conductivity and contaminant content of the lubricant (not shown) in the lubrication system.

The engine lubrication system includes the engine lubricant (not shown), and an oil distribution system typically including an oil pump (not shown) and an oil filter (not shown). The engine lubricant may also be referred to as oil, motor oil, or engine oil. The engine oil may be, by way of non-limiting example, derived from petroleum-based and non-petroleum-synthesized chemical compounds which may include hydrocarbons, polyolefins, and synthetic esters, and which may further be composed of additives including, for example, corrosion inhibitors and anti-wear additives. The oil filter may be a spin-on, canister or cartridge type, or of any configuration used in an internal combustion engine.

As described previously, the engine oil and engine filter have a finite useful life which is less than the useful life of the engine, and therefore must be replaced periodically. The periodic replacement of the engine oil and engine filter is referred to as an oil change, and may be referred to herein as an oil change event. The controller 20 may be configured to receive an input, which may be an input from one or more of the engine 15, an engine control module or oil control module, which may be included in the controller 20, or other input, such as an external input from an oil change service provider through a system input in communication with the controller 20, to signal the controller 20 that an oil change has been completed on the engine 15, e.g., an oil change event has occurred.

The controller 20 may be a single control device or a distributed networked control device that is electrically connected to or otherwise placed in electrical communication with the engine 15, the output 35 and the locating device 30 via suitable control channels. Such control channels may include any required transfer conductors providing a hard-wired or wireless control link suitable for transmitting and receiving the necessary electrical control signals for proper information flow control and coordination aboard the system 10. The control system 20 may include such additional control modules and capabilities as might be necessary to execute the required information flow control functionality within the system 10 in the desired manner.

Still referring to FIG. 1, the control system 20 may be configured as a host machine, e.g., a digital computer or microcomputer, acting as a control module, and/or as a proportional-integral-derivative (PID) controller device having a microprocessor or central processing unit (CPU), read only memory (ROM), random access memory (RAM), electrically-erasable programmable read only memory (EEPROM), high speed clock, analog-to-digital (A/D) and digital-to-analog (D/A) converter circuitry, and input/output circuitry and devices (I/O), as well as appropriate signal conditioning and buffer circuitry. Any algorithms, reference tables and databases resident in the control system 20 or accessible thereby, including the algorithm 25 can be stored on computer-readable media and automatically executed or accessed by the hardware components of the control system 20, e.g., a host machine, in order to provide the respective functionality. The controller 20 may be implemented via any number of computing devices or control modules used in, e.g., a system 10. As such, the controller 20 may be implemented by any combination of an engine control module, an oil change monitor, a vehicle navigation system including the locating device 30, and a display module including the output 35. The algorithm 25 can be programmed as a computer-executable set of instructions or code, and stored on a tangible computer-readable medium or distributed media. Such instructions or code can then be selectively executed by associated hardware components of the system 10, including the controller 20, locating device 30 and output 35.

A system for determining a maximum oil change limit of the engine 15 is provided. The system may include the engine 15, the locating device 30 configured to provide a current location indicator of the engine 15 in response to a current trigger, and the controller 20 in communication with the locating device 30. The locating device 30 may include, for example, a global positioning system (GPS) receiver. The current location indicator of the engine 15 may be in any suitable format to indicate a geographic location of the engine, for example, the location indicator may be State Plane coordinates, Universal Transverse Mercator coordinates, geographic coordinates provided in terms of longitude, latitude, and or altitude, units common to other coordinate systems or map projections, and/or a combination of these.

The current location indicator provided to the controller 20 may be correlated to or translated into a current location rating using, for example, a lookup table which may be provided to and/or stored in the controller 20 that includes a list of location indicators versus location ratings. The location rating, as used herein, is intended to provide a relative rating of the corrosive impact of the environment in which the engine is located and being operated at the time the location indicator is provided. The corrosive impact of the engine's operating environment, represented by a location rating, can be factored into a determination of an oil change index by the controller 20, which can then be used by the controller 20 to determine a maximum oil change limit for the engine 15. An engine operating environment which is more corrosive is likely to decrease the useful life of the engine lubricant and the oil filter, thus reducing the maximum oil change limit (the maximum time in service and/or miles or hours in service until the next recommended oil change). An engine operating environment which is less corrosive may increase the useful life of the engine lubricant and the oil filter, thus allowing the maximum oil change limit to be extended.

Referring now to FIG. 3, shown is a schematic illustration of a partial map of North America defining various geographic areas designated by their respective corrosivity rating as C0, C1, C2, C3, and C4. The corrosivity rating C0, C1, C2, C3, and C4 corresponds to a rating of the severity of the corrosive environment in each respective area shown, as related to an engine operating environment. For example, an area rated as C0 represents the environment which is least corrosive to an engine, including the engine lubrication system, due in part to the lower humidity and moderate temperature conditions which may be present in that area. The area rated as C4 is represented as the environment which is most corrosive to an engine, including the engine lubrication system, due in part to, for example, extreme temperature fluctuations, high humidity, and other factors, such as saltwater or other corrosive factors represented in these areas. The regional areas and associated corrosion severity (corrosivity) ratings illustrated by FIG. 3 are intended to be shown as a representative example of a scheme to provide a corrosivity rating system for a geographic area. It would be understood that any environmental corrosivity scale developed to provide a classification system for predicting atmospheric corrosivity impact may be employed. An example of such a system is the ratings provided by the International Organization for Standardization (ISO) Technical Committee 156 WG4 worldwide atmospheric exposure program, also known as CORRAG. Other corrosion severity rating systems may be used, for example, corrosion severity rating systems developed by major vehicle or engine manufacturers from, for example, vehicle or engine warranty and repair data, to provide corrosion severity rating systems relevant to vehicle components such as engines, engine lubrication systems, oil filters, and lubricants.

The trigger which initiates a request for location indicator to the locating device 30 may be defined by one of a calendar time, an engine-on event, a key-on event, an oil change event, or may be one of a signal provided by an engine control unit, a signal provided by an oil change monitor, and/or a signal provided by the controller 20. By way of non-limiting example, a trigger may be initiated each time the engine is started up, e.g., at an engine on event, or in a case where the engine is a vehicle engine, each time the vehicle is turned on, e.g., at a key-on event. As another example, a trigger may be initiated at a set interval of calendar time, for example, daily, weekly, biweekly, monthly, or as required by the controller 20 and/or the algorithm 25. As another example, a trigger may be initiated upon first use of the engine, to provide an initial location indicator, which may be used by the controller 20 to provide an initial location rating and an initial oil change index which may be used to determine an initial maximum oil change limit for the engine 15. As yet another example, a trigger may be initiated each time an oil change event occurs on the engine 15, which may be used in the process of resetting the maximum oil change limit after the oil change has been completed.

The controller 20 may be configured to generate a current oil change index using the current location indicator and a current location rating, where the current location indicator and the current location rating are provided as described previously, to store at least one prior oil change index, to generate a maximum oil change limit for the engine 15 using at least one of the current oil change index and at least one prior oil change index, and to store the maximum oil change limit.

By way of a non-limiting example, the controller 20 may determine a current oil change index, which corresponds to the current location rating, e.g., the current operating environment of the engine, which is then used by the controller 20 to determine a maximum oil change limit based on the operating environment of the engine at that point in time, which is the current time. The controller 20 may employ an algorithm 25 for this purpose. The maximum oil change limit may be expressed in terms of the lesser of a specified time in service, engine hours or cycles of operation, and/or vehicle miles in service from the last oil change event.

For example, a nominal, or default, maximum oil change limit may be 7,500 miles or 6 months in service, whichever occurs first, for an internal combustion engine installed in a vehicle with a conventional (non-hybrid) powertrain, where no adjustment or consideration is made for the operating environment of the engine, e.g., the geographical location in which the engine is being operated. As another example, the maximum oil change limit may be 10,000 miles, 12 months in service, or 200 hours of engine operation, whichever occurs first, for an internal combustion engine installed in a vehicle with a hybrid powertrain, where no adjustment or consideration is made for the operating environment of the engine, e.g., the geographical location in which the engine is being operated. These examples are provided for illustrative purposes, and are not intended to be limiting.

The maximum oil change limit may be extended, e.g., lengthened in time or miles in service, when the location rating and/or oil change index indicates the engine is located or being operated in a less corrosive environment, for example, the geographic area corresponding to C0 in FIG. 3. For illustrative purposes only, the maximum oil change limit for an engine 15 operating in a vehicle with a conventional (non-hybrid) powertrain in a less corrosive environment may be extended to 7,500 miles or 12 months in service, in consideration of the decreased risk of a corrosion related failure of the oil filter and/or engine lubricant.

The maximum oil change limit may be maintained at a nominal, or default oil change limit, for example, when the location rating and/or oil change index indicates the engine is located or being operated in a moderate environment which may be the geographic areas corresponding to C1 and C2 in FIG. 3.

The maximum oil change limit may be contracted, e.g., shortened in time or miles in service, when the location rating and/or oil change index indicates the engine is located or being operated in a more corrosive environment, such as the geographic areas corresponding to C3 and C4 in FIG. 3. For illustrative purposes only, the maximum oil change limit for an engine 15 operating in a vehicle with a hybrid powertrain in a more corrosive environment may be contracted to 7,500 miles, 6 months in service, or 150 hours of engine operation, in consideration of the increased risk of a corrosion related failure of the oil filter and/or engine lubricant.

Maximum oil change limit may be varied (recalculated) each time a trigger provides a change in the engine location indicator which corresponds to a change in the location rating, to reflect the change in the corrosivity of the operating environment of the engine 15. By time-weighting the oil change indices generated for the engine 15 in each of the location ratings, and determining the maximum oil change limit based on the relative amount of time the engine 15 has been operated in each corrosivity zone, the maximum oil change limit may be optimized in consideration of the engine's operating environment. The maximum oil change limit, as an absolute value, may vary between oil change events, as the engine 15 is moved from one corrosivity zone to another, and as the change in engine location is provided to the controller 20 in response to periodic triggers.

The controller 20 may be configured to generate the maximum oil change limit of the engine using a combination of factors and/or inputs, which may include the current oil change index determined using the current location rating, and which may further include a prior oil change index, e.g., an oil change index determined in response to a prior trigger, and corresponding to a prior locating rating. It would be understood that the prior and current location ratings may be the same, in the event the engine is operating in an environment corresponding to the same location rating at the time the prior and current triggers are provided. In this instance, the prior and current oil change indices provided by the controller 20 may be the same, or may be different, depending on the configuration of the algorithm 25. For example, the algorithm 25 used to calculate the oil change index may be configured to consider variables in addition to the location rating in determining the oil change index, which may be, for example, the age of the engine, or other indicators of useful oil life such as the operating temperature, viscosity, contaminant content, and/or conductivity of the engine oil as determined by other sensors or inputs provided to the controller 20. Consideration of these additional variables may result in a current oil change index which may be different from a prior oil change index, even though the same location rating is used to generate both the prior and current indices.

As another non-limiting example, the controller 20 may be configured to measure the elapsed time between the current trigger and a last trigger, and to time-weight the current location rating using the elapsed time, to generate the current oil change index using the time-weighted current location rating, and to generate the maximum oil change limit as a time-weighted maximum oil change limit. This may be advantageous, for example, when it is determined that the engine has operated in a more corrosive environment such as a C3 or C4 location (see FIG. 3) for only a brief period of time. By time-weighting each location rating and each oil change index for the elapsed time, and using multiple oil change indices (the current oil change index and at least one prior oil change index) to determine the maximum oil change limit, the algorithm 25 and/or controller 20 may determine a maximum oil change limit which correlates to the proportional time the engine has been located or operated at each location, thus decreasing the risk of over-extending the maximum oil change limit where the current location is a less corrosive location, and decreasing the risk of over-contracting the maximum oil change limit where the current location is a more corrosive location.

Each time a current trigger is provided to the locating device 30 to send a current location indicator to the controller 20, the controller 20 generates a new maximum oil change limit, using at least the current oil change index defined at least in part by the current location rating corresponding to the current location indicator, and optionally, other factors such as one or more prior oil change indices or other inputs as described previously.

It would be understood that the maximum oil change limit will vary over time. For an engine 15 initially placed in service, e.g., an engine 15 with no time in service, the maximum oil change limit may be established as a default value, which may correspond to an average oil change limit or a worse case oil change limit, by way of non-limiting example. As another example, the system 10 and/or controller 20 may be configured such that at a first engine-on event, a trigger is sent to the locating device 30 to provide an initial location indicator to the controller 20. The initial location indicator is used by the controller 20 to determine an initial location rating, and to generate an initial oil change index and maximum oil change limit for the engine 15.

Each time the engine 15 has an oil change performed, e.g., each time the engine 15 undergoes an oil change event, the controller 20 may receive an input indicating an oil change event has occurred. The controller 20 may respond by resetting the maximum oil change limit, which may be reset to a default value, to a value established by triggering the locating device 30 to send a current location indicator to the controller 20 to be used to calculate a current maximum oil change limit, or to another value, for example, the last maximum oil change limit generated and stored prior to the most recent oil change event.

Each time the maximum oil change is generated in response to a (current) trigger, the generated maximum oil change limit is stored in the system 10, for comparison with the last oil change event. The last oil change event may be, for an engine 15 newly put into service, the calendar time the engine 15 is initially put into service, e.g., the first engine-on event corresponding to zero engine revolutions (cycles) and/or zero miles in service (for an engine 15 installed in a vehicle 10), and/or zero time in service. For an engine 15 which has been operated, e.g., which has been in service, the last oil change event corresponds with the calendar time at which the last oil change event occurred, which may also be associated in a database accessible by the controller 20 with the time, mileage, or number of hours or revolutions (engine cycles) in service of the engine 15 at the time the last oil change was performed.

The controller 20 may be configured to receive the last oil change event as an input, and to compare the maximum oil change limit and the last oil change event to determine when the maximum oil change limit has been met or exceeded. The controller 20 may be further configured to output an oil change limit alert when the maximum oil change limit is met or exceeded, for example, to the output device 35. The output device 35 may be configured to communicate at least one of the maximum oil change limit and an oil change limit alert generated by the controller 20, thereby providing notification that an oil change is recommended and/or required for the engine 15. The output device 35 may be configured to communicate the maximum oil change limit and/or the oil change limit alert using one or more of an audio or visual output, as described previously.

FIG. 2 is a schematic illustration of a method for generating and monitoring the maximum oil change limit on an engine, such as the engine 15 shown in FIG. 1. The method is employed to maximize the oil change limit for the engine 15 by inputting an indicator of the engine operating environment, such as a location indicator, into the determination of the maximum oil change limit for the engine. The method includes, at step 50 shown in FIG. 2, and referring also to FIG. 1, providing a current location indicator of an engine, such as engine 15, to a controller, such as the controller 20, in response to a current trigger. The location indicator of the engine 15 may be provided using a locating device, such as locating device 30 in communication with the controller 20, wherein the locating device 30 may be configured to include a global positioning system (GPS) receiver. The trigger, as described previously, may be one of a calendar time, a key-on event, an oil change event, a signal provided by an engine control module, a signal provided by an oil life monitor, and a signal provided by the controller 20.

At step 55, the controller 20 generates a current oil change index using the location indicator provided by the locating device 30 at step 50, and uses the current oil change index to generate and store a maximum oil change limit for the engine 15. The controller 20 may use the current location indicator received as an input to step 50 to determine a current location rating for the engine location, using, for example, a reference table stored in the controller 20 or system 10 correlating the location indicator to a location rating. The location rating, as described previously, may be correlated to a corrosivity rating for the corresponding location indicator. The corrosivity rating provides a relative rating of the severity of environmentally-related corrosion of the engine including the engine lubrication system, engine lubricant and oil filter, for a given geographic location. The controller 20 may generate the current oil change index using the current location rating corresponding to the current location indicator. The controller 20 may use an algorithm 25 to generate the current oil change index and/or the maximum oil change limit. The controller 20, after using the current oil change index to determine the maximum oil change limit, may store the current oil change index as a prior oil change index. Other information may be stored with the prior oil change index, including one or more of, for example, the time the trigger associated with the oil change index was provided to the locating device 30, the elapsed time between the trigger and a last trigger, the location indicator associated with the oil change index, and/or other engine operating parameters or characteristics determined at the time the trigger was provided, such as engine hours in service, engine lubricant characteristics such as viscosity, temperature, contaminant content, and/or conductivity, engine revolutions (cycles) or hours in service, and/or the vehicle mileage for vehicle-installed engine configurations.

The maximum oil change limit generated at step 55 may be generated, as described previously for FIG. 1, using the current oil change index, or using the current oil change index and at least one prior oil change index. The current oil change index, one or more prior oil change indices, the maximum oil change limit and other related information such as location indicators associated with the oil change indices, may be stored in a database accessible by the controller 20 for use in determining the maximum oil change limit. A prior oil change index may include at least one of an oil change index provided to the oil change monitor as an initial oil change index, and an oil change index generated after a last oil change event in response to a prior trigger. Generating a current oil change index may include measuring the elapsed time between the current trigger and a last trigger, time-weighting the current location rating using the elapsed time, and generating the current oil change index using the time-weighted current location rating. The maximum oil change limit generated using one or more time-weighted oil change indices may be provided as a time-weighted maximum oil change limit. Optionally, at step 55, the maximum oil change limit may be provided as an output of the controller 20, for example, to the output device 35.

The method may, at step 60, include inputting a last oil change event into a database in or accessible by the controller 20, and comparing the maximum oil change limit to the last oil change event. A first engine-on event may be stored as the last oil change event for an engine 15 when the engine 15 is initially placed in service, e.g., put into use.

If, at step 60, the controller 20 determines the maximum oil change limit has been met or exceeded when compared to last oil change, the method proceeds to step 65 and the controller outputs an oil change limit alert. The oil change limit alert may be provided, for example, to the output device 35, which may be configured to communicate the oil change limit alert by means of an audio or visual signal, as described previously. In the instance where engine 15 is an engine installed and operating in a vehicle 10, the oil change limit alert may be provided to the vehicle operator by, for example, activating an oil change light on the vehicle instrument panel, providing a human readable or audio message through a driver information system, or providing the alert through a vehicle or driver information system in communication with one of the controller 20 and the output device 35, where the output device 35 may be included in the vehicle information system.

At step 70, the engine undergoes an oil change event, which, as previously described, generally includes removal and replacement of the oil filter and engine lubricant of the engine 15. The oil change event at step 70 includes providing an input to the controller 20, to signal the controller 20 to reset the maximum oil change limit and to store the oil change event as a last oil change event. The input may be provided by the engine 15, an engine control module, and oil life monitor, an input to the driver information system, or other input provided, for example, by a service technician through a network in communication with the controller 20.

Upon completion of the oil change event, the method continues at step 55, where the controller 20 generates a new maximum oil change limit and stores the oil change event as the last oil change event. The new maximum oil change limit may be, as described previously, generated as one of a default value, as a limit equal to the most recently generated maximum oil change limit, as an oil change limit generated using a current location indicator, as an oil change limit generated using one or more prior oil change indices, or as another maximum oil change limit determined, for example, by an algorithm 25 manipulating one or more factors including a factor defined by a location rating.

Returning now to step 60, if the controller 20 determines the maximum oil change limit has not been met or exceeded when compared with last oil change event, the method returns to step 50 and proceeds as described when the next trigger is provided to the locating device 30. Upon receiving the next trigger, which is the current trigger, the method is repeated, e.g., a current location indicator is provided to the controller 20, which is used to determine a current location rating for the location of the engine 15 provided by the locating device 30. At step 55 the controller generates a current oil change index using at least the current location rating, and then generates (refreshes) the maximum oil change limit using at least the current location rating and at least the current oil change index, as described previously. At step 60, the refreshed, e.g., newly generated maximum oil change limit is compared with the last oil change event, and as described previously, an oil change limit alert is activated or outputted at step 65 if the maximum oil change limit is met or exceeded, or alternatively, if the maximum oil change limit is not met or exceeded, the method is initiated again at step 50 when the next trigger is provided to the locating device 30.

While the best modes for carrying out the invention have been described in detail, those familiar with the art to which this invention relates will recognize various alternative designs and embodiments for practicing the invention within the scope of the appended claims.

The invention claimed is:

1. A method of determining a maximum oil change limit of an engine, the method comprising:

providing a current location indicator of an engine to a controller in response to a current trigger;

wherein the controller is configured to generate and store an oil change index and a maximum oil change limit;

generating a current oil change index using the current location indicator and a current location rating;

generating the maximum oil change limit of the engine using one of:

the current oil change index, and the current oil change index and an at least one prior oil change index; and storing the maximum oil change limit using the controller.

2. The method of claim 1, further comprising:

providing the maximum oil change limit as a output of the controller.

3. The method of claim 1, further comprising:

inputting a last oil change event into the controller;

comparing the maximum oil change limit to the last oil change event; and outputting an oil change limit alert when the maximum oil change limit has been met or exceeded, using the controller.

4. The method of claim 1, wherein the current trigger is one of a calendar time, an engine-on event, an oil change event, a signal provided by an engine control unit, a signal provided by an oil life monitor, and a signal provided by the controller.

5. The method of claim 1, wherein the at least one prior oil change index includes at least one of:

an oil change index provided to the controller as an initial oil change index, and an oil change index generated after a last oil change event in response to a prior trigger.

6. The method of claim 5, further comprising:

measuring an elapsed time between the current trigger and a last trigger;

time-weighting the current location rating using an elapsed time;

generating the current oil change index using the time-weighted current location rating; and generating the maximum oil change limit as a time-weighted maximum oil change limit.

7. The method of claim 1, further comprising:

providing the location indicator of the engine using a locating device in communication with the controller.

8. The method of claim 7, wherein the locating device is configured to include a global positioning system (GPS) receiver.

9. The method of claim 1, wherein the engine is an internal combustion engine on a vehicle.

10. The method of claim 9, wherein the current trigger is one of a calendar time, a key-on event, an oil change event, and a signal provided by the controller.

11. The method of claim 9, wherein the vehicle is configured as one of a hybrid vehicle and an extended range electric vehicle.

12. A system for determining a maximum oil change limit of an engine, the system comprising:

an engine;

a locating device configured to provide a current location indicator of the engine in response to a current trigger;

a controller in communication with the locating device, the controller configured to:

generate a current oil change index using the current location indicator, store an at least one prior oil change index, generate a maximum oil change limit for the engine using at least one of the current oil change index and the at least one prior oil change index, and store the maximum oil change limit.

13. The system of claim 12, wherein the current trigger is one of a calendar time, an engine-on event, an oil change event, a signal provided by an engine control unit, and a signal provided by the controller.

14. The system of claim 13, wherein the controller is further configured to:

measure the elapsed time between the current trigger and a last trigger, time-weight the current location rating using the elapsed time, generate the current oil change index using the time-weighted current location rating, and generate the maximum oil change limit as a time-weighted maximum oil change limit.

15. The system of claim 12, wherein the locating device includes a global positioning system (GPS) receiver.

16. The system of claim 12, wherein the controller is further configured to:

receive a last oil change event as an input, compare the maximum oil change limit and the last oil change event, and output an oil change limit alert when the maximum oil change limit is met or exceeded.

17. The system of claim 16, further comprising:

an output device configured to communicate at least one of the maximum oil change limit and an oil change limit alert.

18. The system of claim 12, wherein the engine is an internal combustion engine in a vehicle; and the trigger is one of a calendar time, a key-on event, an engine-on event, an oil change event, a signal provided by an engine control unit, a signal provided by an oil life monitor, and a signal provided by the controller.

19. The system of claim 18, wherein the vehicle is one of a hybrid vehicle and an extended range electric vehicle.

20. A vehicle including an engine, the vehicle configured to determine a maximum oil change limit of the engine, the vehicle comprising:

an engine;

a GPS receiver configured to provide a current location indicator of the vehicle in response to a current trigger;

a controller in communication with the GPS receiver, the controller configured to:

generate a current trigger, generate a current oil change index using the current location indicator, store an at least one prior oil change index, generate a maximum oil change limit for the engine using at least one of the current oil change index and the at least one prior oil change index, store the maximum oil change limit, receive a last oil change event as an input, compare the maximum oil change limit and the last oil change event, and output an oil change limit alert when the maximum oil change limit is met or exceeded;

an output device configured to communicate at least one of the maximum oil change limit and an oil change limit alert; and wherein the vehicle is one of a hybrid vehicle and an extended range electric vehicle.

* * * * *